United States Patent [19]

Henning

[11] 4,007,790

[45] Feb. 15, 1977

[54] BACK-OFF APPARATUS AND METHOD FOR RETRIEVING PIPE FROM WELLS

[76] Inventor: Jack A. Henning, P.O. Box 158, Refugio, Tex. 78377

[22] Filed: Mar. 5, 1976

[21] Appl. No.: 664,194

[52] U.S. Cl. ..... 166/299; 166/63; 166/178; 166/301; 175/301

[51] Int. Cl.[2] ..... E21B 23/04

[58] Field of Search ..... 166/63, 299, 301, 178, 166/237, 250; 102/21.8; 175/301, 4.56, 293

[56] References Cited

UNITED STATES PATENTS

| | | | |
|---|---|---|---|
| 1,560,815 | 11/1925 | Hill | 166/55 |
| 2,251,113 | 7/1941 | Chapman | 166/178 X |
| 2,358,466 | 9/1944 | Miller | 166/178 |
| 2,839,143 | 6/1958 | Alexander | 166/301 |
| 3,157,119 | 11/1964 | Porter | 175/4.56 X |
| 3,180,261 | 4/1965 | Moore | 175/4.56 X |
| 3,374,735 | 3/1968 | Moore | 102/21.8 |
| 3,491,830 | 1/1970 | Sweetman | 166/301 X |

*Primary Examiner*—Stephen J. Novosad
*Attorney, Agent, or Firm*—Pravel, Wilson & Gambrell

[57] ABSTRACT

A new and improved apparatus and method for lowering the apparatus downwardly in a drill string on a wireline to releasably engage a recess in a threaded joint or collar of the drill string to prevent further downward movement of the apparatus and to thereafter detonate an explosive by manipulating a wireline actuated jar with repeated downward blows for exerting a jarring force to the joint as a result of the explosion to release the threads at the joint upon simultaneous application of a back-off torque to the drill string. The apparatus can be released and removed from the well without breaking or damaging the collar locating and supporting portion of the apparatus.

18 Claims, 7 Drawing Figures

W
10
12
11
15
22
21
14
19
20
23
25
26
27
24
17
28
16a
16
29b
29a
41
35
18
36
38b
38a
31b
31a
30b
30a
28
37
39
40
33
32
34
43a
39
34
42
44
46
43
47
45
49
43b
48
51
53
50a
50
58
59a
59a
52
59
59
p'
57b
57a
60
54
67
55
59c
56
C
56a
63
62
59d
61a
68
61
64
p
P
59
62
61a
63
63
61a
61
59
W
J
p'
11

BACK-OFF APPARATUS AND METHOD FOR RETRIEVING PIPE FROM WELLS

BACKGROUND OF THE INVENTION

This invention relates generally to the field of wireline back-off tools which detonate an explosive charge for creating a jarring force to release a selected threaded pipe connection in a pipe string.

During the drilling of a well, the drill string may become stuck in the well making it impossible to remove the drill string by pulling and/or rotating the string in the usual manner. Since a drill string is made up of multiple sections of drilling pipe which are joined together with a threaded connection formed at the mating ends of the pipe or with the use of a coupling at the threaded ends, in some cases, the upper portion of the drill string above the section of pipe which has become stuck in the well may be unthreaded from the stuck portion so that at least the upper portion of the drill string may be pulled out of the well. Since the threaded connections joining sections of a drill string are usually tightly connected, the release of one of such connections in the pipe string has been accomplished by applying a back-off torque to the pipe string and detonating an explosive charge adjacent the threaded connection to be released. The shock of the explosion serves as a jar to cause the threaded connection to release by the action of the reverse torque. Such an apparatus and method is disclosed in U.S. Pat. No. 2,305,261 issued on Dec. 15, 1942 to M. M. Kinley. Other apparatus has been disclosed with drill collar locators for positioning an explosive device adjacent a drill collar. Such apparatus is disclosed in U.S. Pat. Nos. 1,560,815, 3,157,119, 3,180,261 and 3,374,735.

SUMMARY OF THE INVENTION

This invention relates to a new and improved apparatus and method for releasing a threaded connection joining sections of a drill string or other similar pipe string.

In particular, this invention includes a new and improved apparatus and method for locating a back-off tool using an explosive charge at a selected threaded connection joining sections of a drill string and supporting the back-off tool in an internal recess or shoulder in the threaded connection so as to apply a jarring or hammering force to the threaded connection while applying a reverse torque on the upper portion of the pipe to thereby release the threaded connection, and permit removal of the upper portion of the pipe from the well. In the preferred embodiment, the support means includes a plurality of resilient fingers which are held biased inwardly with a locator means so that the apparatus may be lowered through the drill string. The preferred embodiment also has a locator means which is operable upon upward engaging movement with a shoulder or recess in a threaded pipe connection to release the support means so as to engage the threaded connection to lock and support the apparatus in the well string against further downward movement. A wireline actuated jar supports the apparatus and can be manipulated to apply repeated jarring or hammer-like blows to the connection to effect the detonation of the explosive without risk of the tool becoming inadvertently unseated or released. However, the apparatus can be readily removed from the well after firing the explosive without breakage or damage to the collar-supporting portion of the apparatus.

DESCRIPTION OF THE PREFERRED EMBODIMENT

Figure 1A:
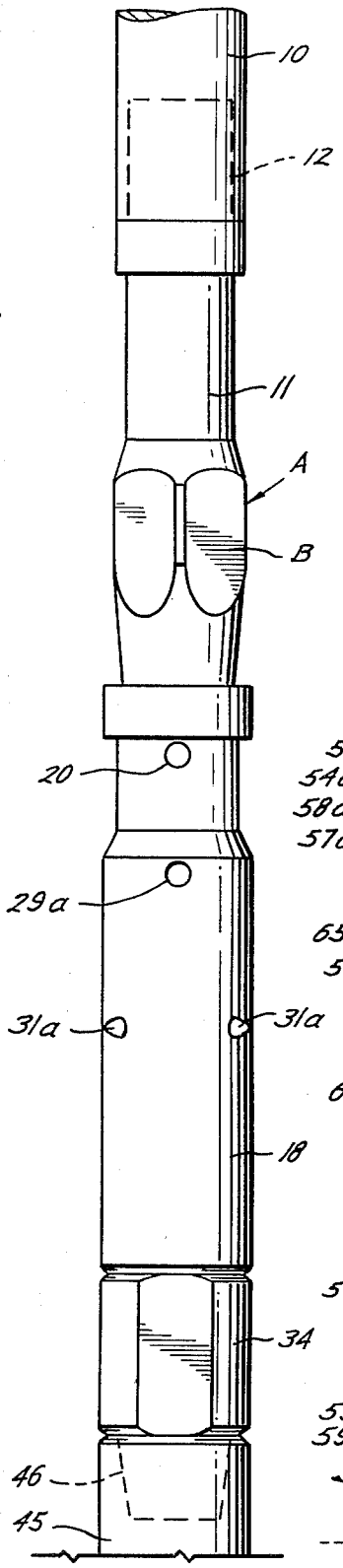
FIG. 1A is a side elevation of an upper portion of the back-off apparatus.

In the drawings, the letter A designates generally a new and improved back-off apparatus of this invention (FIGS. 1A and 1B) which is used to effect release of a connection designated generally by the letter C joining two sections of a drill string. It is understood that the connection C is generally located several hundred feet below the top of the drill string and may typically be located below several hundred feet of water in situations involving offshore drilling.

Figure 1B:
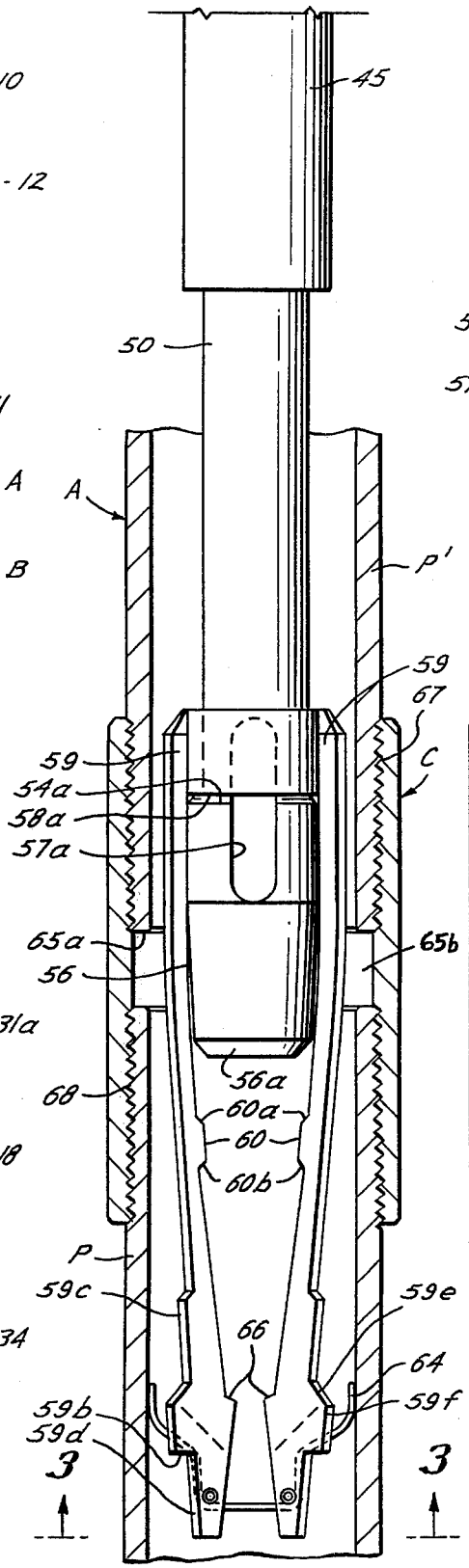
FIG. 1B is a side elevation of a lower portion of the apparatus with the support means in the extended, retracted position for movement through the well screen.

As shown in FIGS. 1A and 1B, the back-off apparatus A is connected at its upper end to a rope socket or wireline connector 10 which is in turn suspended from a drilling work surface by a wireline W. The hammer body 11 is connected by suitable means such as screw threads 12 to the rope socket. Flat wrench surfaces 13 are provided on the hammer body for the positioning of a wrench thereon. Hammer means 14 (FIG. 4A) forms a part of the hammer body and is connected to the hammer body with screw threads 15. At the lower end of the hammer means is a hammer head 16 which strikes a firing pin as will be described hereafter. The hammer means includes a collar portion 17 which engages the upper sleeve portion 18 of the elongated tool which forms this apparatus. Aperture 19 extends through the hammer means and is adapted to receive a shear pin 20 which prevents accidental firing of the charge. The pin 20 when typically made of steel needs a substantial force or blow for its shearing which avoids accidental firing of the explosive during positioning of the apparatus. In practice it may take several blows to shear a steel pin. A less stronger pin, for instance brass, may be used and more than one pin may be used.

The upper sleeve portion 18 of the tool includes a passage extending therethrough beginning with tapered portion 21 which mates with a similar tapered portion 22 on the hammer means when the hammer means is forced downwardly to shear the pin 20. The tapered portion 21 of the passage extends downwardly to a constant diameter portion 23 which ends in a stop portion 24 which has an upper surface 25 upon which rests a washer 26. The washer 26 acts between the upper surface 25 of the stop portion and the shear pin 20 to prevent downward movement of the hammer body until the shear pin is sheared. Lower surface 27 of the stop portion 24 is engaged by the collar portion 17 of the hammer means to prevent upward movement of the hammer means out of the upper sleeve portion. The diameter of the hammer means 14 is slightly less than the diameter of the stop portion 24 and the diameter of the collar portion 17 is slightly less than the enlarged surface 28 of the upper sleeve portion to allow downward longitudinal movement of the hammer body upon breaking of the shear pin 20.

The upper sleeve portion includes apertures 29*a* and 29*b* for release of any fluid trapped in the passageway upon downward movement of the hammer means. The recesses 30*a* and 30*b* are provided in the enlarged surface 28 for receiving shear pins 31*a* and 31*b* respectively. Lower end surface 32 of the upper sleeve portion engages surface 33 of the firing rod body portion 34.

The firing rod body portion 34 includes a neck portion 35 which is adapted to be grasped by a fishing tool as will be explained hereafter. Stepped portion 36 of the neck portion facilitates the connection of a fishing tool. The stepped portion extends to an enlarged portion 37 which has a diameter slightly less than the enlarged surface 28 of the upper sleeve portion to allow insertion and removal of the firing rod body portion from the upper sleeve portion. Recesses 38*a* and 38*b* mate with the recesses 30*a* and 30*b* for receiving the shear pins 31*a* and 31*b* respectively. Should the lower portion of the back-off tool apparatus become stuck, sufficient force applied to the wireline W will shear the pins 31*a* and 31*b* so that the upper sleeve portion 18 may be removed from the firing rod body portion and retrieved with the wireline W so that a fishing tool may be lowered into the well to engage the neck portion 35 of the firing rod portion. Sufficient force may then be applied to the firing rod body portion to lift the back-off tool apparatus from the drill string.

The firing rod 39 is slidably mounted in central aperture 40 in the firing rod body portion and the firing rod includes an upper head 41 which is engageable with lower end 16*a* of the hammer surface. Firing rod 39 includes a lower head 42 which engages the upper surface 43*a* of the firing pin 43. The diameter of the firing pin 43 is less than that of the firing rod 39 and the lower portion 44 of the central aperture is smaller than the upper portion of the central aperture to correspond with the smaller diameter of the firing pin. The upper end of the small diameter portion of the central aperture also engages the lower head portion of the firing rod to limit downward movement of the firing rod 39.

Lower sleeve portion 45 is connected by screw threads 46 to the firing rod body portion 34. The lower sleeve portion includes a passageway 47 having the same diameter as the lower portion 44 of the central aperture 40 for slidably receiving the firing pin 43. The lower portion 48 of the passageway 47 is reduced in diameter and slidably receives the reduced diameter portion 43*b* portion of the firing pin. Stepped portion 49 of the passageway 47 acts as a lower stop for the lower end 43*c* of the firing pin 43.

A finger support member 50 is connected with the lower sleeve portion 45 by screw threads 51. The support portion 50 includes a central passageway 52 which receives at its upper end an explosive charge 53. The explosive charge includes a firing cap (not shown) which is positioned to be engaged by the lower end of the firing pin. The explosive charge 53 may be retained in position in the central passageway 52 by engagement with the upper end of the support member or by other suitable means. The support member extends downwardly to an enlarged head portion 54 which includes an upper outer surface 55 which extends to an inwardly tapered lower outer surface 56. Slots 57*a* and 57*b* are provided in the support portion and extend into the passageway to provide an outlet for the expanding gases formed upon ignition of the explosive charge 53. Slidably mounted on the upper outer surface 50*a* of the finger support portion is a collar member 58 to which is welded a plurality of spring resilient fingers 59 which extend downwardly from the collar portion 58. The upper camming surfaces 59*a* of the resilient fingers have a spacing slightly greater than the diameter of the upper outer surface 55 of the support head portion 54. As shown in FIG. 1B, the upper surface 54*a* engages the lower surface 58*a* of the collar to limit longitudinally extension or telescoping of the collar when it engages the upper surface 54*a.*

Figure 2:
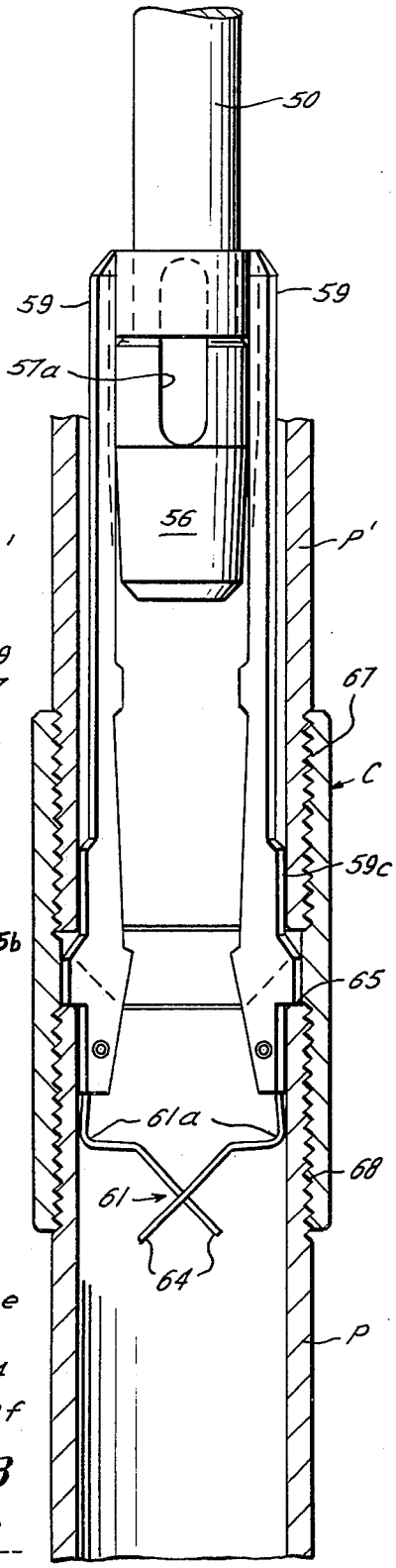
FIG. 2 is a side elevation of the support means engaged with a threaded connection after release of the support means by the locator means.
Figures 3, 4A, 4B, 5:
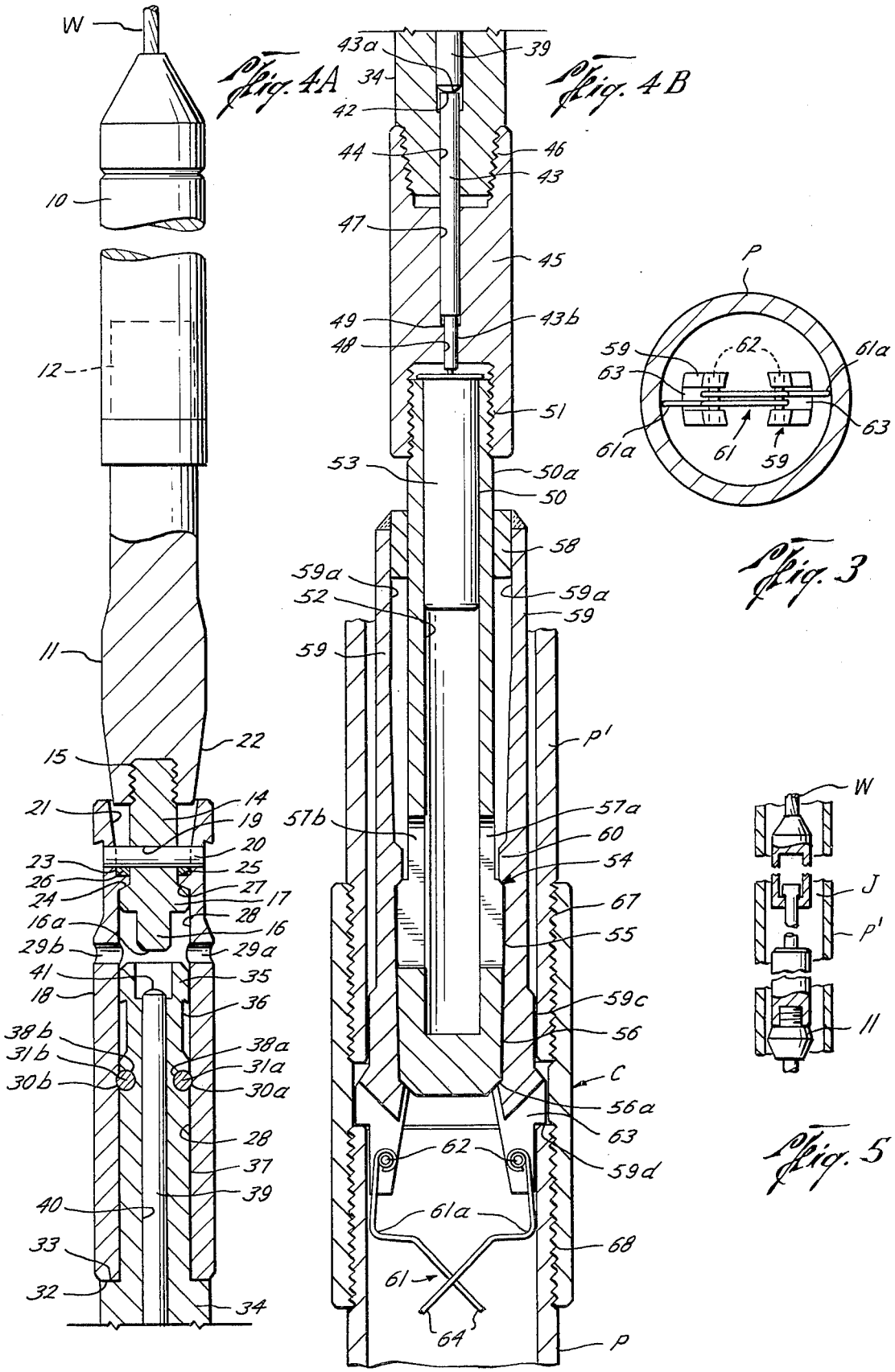
FIG. 3 is a view taken along line 3—3 of FIG. 1B.
FIG. 4A is a side elevation of an upper portion of the back-off apparatus, partly in cross section.
FIG. 4B is a side elevation of a lower portion of the back-off tool taken partly in section and with the support means in the retracted position locked in engagement with the threaded connection.
FIG. 5 is a side elevation of a wireline actuated jar used with the apparatus.

As shown in FIG. 1B, the resilient fingers 59 may be biased inwardly to engage the lower tapered outer surface 56 of the head portion 54. The resilient fingers include inner enlarged stops 60 which includes upper surfaces 60*a* and lower surfaces 60*b* which respectively engage the surfaces 56*a* and 54*a* of the head portion. The surfaces 60*a* help retain the resilient fingers or support means in the extended position as shown in FIG. 1B and the surfaces 60*b* act to retain the head portion 54 in the retracted position as shown in FIG. 4B. A plurality of spring locating means 61 are pivotally mounted on pins 62 in slots 63 in the resilient fingers 59. Each bent portion 61*a* of the spring locating means is adapted to be hooked over one of the pivot pins 62 when the resilient fingers are biased inwardly as shown in FIG. 1B. The spring locating means retains the fingers 59 in the inwardly biased position as shown in FIG. 1B for movement of the back-off tool apparatus through the drill string and past connection C. End portions 64 of the spring locating means 61 ride against the drill string and act to maintain the spring fingers centered in the drill string. The resilient fingers 59 include support lugs 59*d* which are adapted to engage an upper surface 65 on the drill pipe P as shown in FIGS. 2 and 4B.

The resilient fingers 59 include upper outer enlarged portions 59*c* and lower outer enlarged portions 59*f* which in the position as shown in FIG. 4B are spaced apart a distance substantially corresponding to the diameter of the drill pipe P. Lower outer enlarged portion 59*f* extends between the camming surface 59*e* and the support lug 59*d.* As shown in FIG. 4B, the enlarged portion 59*f* is adapted to be positioned adjacent the recess 65*b* formed by the connector C.

The resilient fingers are of sufficient size and strength to support the tool on the connection as well as sustain the force of the explosion. As explained hereinafter, the fingers will also withstand repeated blows from a wireline actuated jar and can be reused with a new explosive charge.

In operation, the back-off apparatus of this invention is lowered through the drill string with the resilient fingers and spring locator means positioned as shown in FIG. 1B. The end portion 64 of the spring locator means 61 engages the inner surface of the drill pipe as the apparatus is lowered through the drill string. The engagement of the end portion 64 with the drill pipe tends to retain the spring locator means in a position shown in FIG. 1B to retain the spring fingers biased inwardly. When the spring fingers are biased inwardly, the lower surface 58*a* and the collar 58 engages the upper surface 54*a* of the head portion 54 and the surface 59*a* of the resilient fingers is tightly held against the tapered surface 56 of the head portion to retain the fingers in the extended position.

When the back-off apparatus has been lowered to a desired general location in the drill string, a next step involves setting the resilient fingers within the recess formed by the connector C so as to limit any further downward movement of the back-off apparatus in the drill string. This is accomplished by raising the back-off apparatus until the end portions 64 of the spring locator means are located in the recess 65*b* to engage the lower end surface 65*a* of the upper pipe P'. Further upward movement of the back-off apparatus will pull the bent portion 61*a* of the spring locating means away from the pivot retaining pins 62 so as to release the resilient fingers from their position shown in FIG. 1B to the position shown in FIG. 4B. The enlarged portions 59*f* of the resilient fingers will be positioned in the recess 65*b* formed by the connector C as shown in FIG. 2. Spring locating means 61 will pivot downwardly under the influence of gravity to their inoperative positions as shown in FIG. 2.

Slacking off the wireline W will allow the back-off tool apparatus to move to the retracted position as shown in FIG. 4B whereby the head portion 54 will be moved downwardly so that the surface 56*a* will engage the surfaces 66 on the resilient fingers to retain the resilient fingers outwardly in the recess 65*b* and in tight engagement with the connector.

As shown in FIG. 5, the invention may be used in connection with a wireline W and a wireline actuated jar J of the link type with suitable weights thereabove (not shown). Such wireline actuated jars are known in the art and not themselves new. When used with the disclosed invention, the wireline actuated jar J can be used to shear the pin 20 and detonate the charge 53. The setting and retaining of the resilient fingers in engagement with the connector is similar to the steps described above for the use of the conventional rope socket 10. As described below, the wireline actuated jar may be used to impart a hammering force to a threaded connection after the detonation of the charge 53.

With the back-off apparatus position as shown in FIG. 4B, the steps for initiating the firing of the charge 53 may be began. The method for firing the charge may be found in U.S. Pat. No. 3,447,604 issued June 3, 1969 to J. C. Kinley et al. As set forth in the Kinley disclosure, a sliding weight may be dropped on the wireline W so as to hit the rope socket 10 with sufficient force to drive the hammer body 11 downwardly to shear the pin 20. The hammer means 14 will engage the firing rod 39 which in turn engages the firing pin 43 to explode the charge 53. The explosive force from the charge 53 will be directed through the passageway 52 and through the slots 57*a* and 57*b*. The explosive charge will provide a jarring force through the support means or resilient fingers to the connector.

It is understood that prior to exploding the charge, a back-off torque is applied to the drill string and the drill string may also be lifted to reduce the weight of the upper section of the drill string beginning with the section P' so as to counteract the forces on the connector C preventing release of the screw threads 67 and 68. The explosive force exerts a force on the support means through the resilient fingers 59 to provide a jarring or hammering action directly to the connection C which facilitates release of the drill string at the connector C.

The back-off apparatus may be removed from the drill string by pulling upwardly with the wireline W. It is understood that the head portion 54 will return to the extended position as shown in FIG. 2 so that the spring fingers 59 may be biased inwardly as the camming surface 59*e* engages the lower surface 65*a* of the drill pipe P'. After removal, a new charge may be inserted so that the apparatus may be used again.

In the case of the wireline actuated jar J as shown in FIG. 5, the back-off apparatus is also set in the position shown in FIG. 4B before detonating the charge. The next steps include the raising of the wireline W to move the jar J to its extended position. In the known manner, this upstroke of the jar positions it so that the slackening of the wireline will allow the jar to drop and deliver a striking or hammering force to the back-off apparatus to shear the pin or pins 20 and thus to detonate the charge, as previously explained. The combination of the explosion with the lifting and reverse torque applied to the drill string is intended to effect release of the connection engaged by the support fingers of the apparatus so that the upper portion of the pipe at the connection and thereabove can be removed from the well, leaving the lower portion in the well for subsequent fishing operations or the like.

In the event that the releasing of the connection is not achieved, the wireline may be raised to position the jar for another dropping of the jar. This may be done several times to make sure that the pin 20 is sheared and the charge is detonated.

If the portion of the pipe above the joint or connection C is not released, the operator does not know whether the explosive has fired. Therefore, the operator usually delivers additional jarring or hammering blows with the jar J by raising and slackening the wireline to operate the jar J in the known manner, so as to be sure the shear pin or pins 20 are severed and the explosive 53 has been detonated. The resilient support fingers are locked in the recess 65*b* of the threaded connection C so repeated blows can thus be imparted to the connection by manipulating the jar J without inadvertently jarring the apparatus out of its desired position adjacent the connection C to be released.

If repeated blows fail to release the connection C, the back-off apparatus may be released from the connection by simply raising the wireline W sufficiently to extend the jar J to its fully extended position and then continuing the upward movement, as explained above without breaking or damaging the fingers 59 or the locators 64. The back-off apparatus may first be raised to the next or higher connection joining sections of the drill string. The back-off apparatus can then be locked into engagement as shown in FIG. 4B with a recess formed by the next connection. Thereafter, the releasing steps of lifting the drill string and applying a back-off torque while at the same time manipulating the jar J to apply a hammering blow to the next connection to attempt to release it can be repeated. As will be apparent, these steps could be repeated as desired but once the explosive is detonated, the apparatus only provides mechanical longitudinal jarring until the apparatus is completely removed and re-set with a new charge of explosive. The back-off apparatus can be removed from the drill string for renewing the charge so that the apparatus can again be run in the well as previously described. It is understood that the locking prevents further downward movement of the apparatus past a connection.

The jar J imparts a hammering or jarring force to the connection at the same time it discharges the explosive charge. The resilient fingers are sufficiently strong to withstand the force of the jar as well as the explosion which deliver one or repeated blows to the connection to effect its release.

The foregoing disclosure and description of the invention are illustrative and explanatory thereof and various changes in the size, shape and materials as well as in the details of the illustrated construction may be made without departing from the spirit of the invention.

I claim:

1. An apparatus for locating and applying a jarring or hammering force to a threaded connection joining sections of a string of drill pipe, comprising:

an elongated tool means for lowering in a well from a wireline;

supporting means with the tool means operable for allowing downward movement of the tool means through the drill string until the tool means has been raised upwardly to a releasable locking position engaging the supporting means with a threaded connection to support the tool means and to thereafter prevent further downward movement of the tool means in the drill string;

locating means with the supporting means and operable upon an upward movement of the tool means for locating a selected connection which is to be released to position the supporting means in the releasable locking position;

explosive means with the tool means operable by manipulation of the wireline for exerting an explosive force adjacent to the connection for imparting a jarring force to the threaded collar connection for effecting release of the threaded upper portion of the connection by reason of the explosion and a back-off torque which is applied to the drill string;

a wireline actuated jar connected to the wireline and adapted to be manipulated by the wireline to detonate the explosive means and to impart an explosive jarring blow to the connection to be released; and said supporting means preventing downward release from the locking position during repeated jars with said wireline actuated jar to thereby assure that when the explosion detonates, it occurs in proximity to the connection to be released.

2. The apparatus as set forth in claim 1, wherein:

said support means is releasable from said connection upon extending the jar and then continuing the upward pull on the wireline which release is effected without breaking or damaging the support means.

3. The apparatus as set forth in claim 1, wherein:

the support means having a camming means to cam the support means toward a retracted position upon raising of the wireline to release the support means from the connection and for movement thereof upwardly in the well.

4. The apparatus as set forth in claim 1, wherein:

the supporting means having a plurality of resilient support fingers operable from the retracted to the locking position to engage the threaded collar connection at the selected location to impart the hammering force to this location.

5. The apparatus as set forth in claim 4, wherein:

the locating means having means retaining the resilient fingers biased inwardly in the first position to allow the tool to be lowered through the drill string and past a collar connection.

6. The apparatus as set forth in claim 5 wherein:

the locating means having means engageable with a collar connection with the engageable means operable when engaged with the collar connection upon upward movement of the locating means to release the resilient fingers; and the resilient fingers having means engageable with the collar connection at the selected location to support the tool against further downward movement.

7. The apparatus as set forth in claim 1, wherein:

the locating means retains the supporting means in the first position and operates the supporting means to the second position.

8. The apparatus as set forth in claim 1, wherein:

the locating means having means engageable with a collar connector to operate the supporting means to the second position by upward movement of the locating means.

9. The apparatus as set forth in claim 1, wherein:

the resilient fingers are slidably mounted on the elongated tool between longitudinally extended and retracted positions and retained by the locating means in the first position biased inwardly and longitudinally extended so that the tool may be lowered past a drill collar.

10. The apparatus as set forth in claim 9, wherein:

the elongated tool having a tapered surface engageable with the resilient fingers in the retracted position to maintain the resilient fingers in the second position preventing further downward movement of the tool.

11. A method for locating and applying a jarring or hammering force to a threaded connection joining sections of a string of drill pipe, comprising:

lowering a back-off apparatus having a wireline actuated jar through a drill string with a wireline;

releasing a locking support means with the back-off apparatus from a non-engaging position for lowering through the pipe string by manipulating the wireline;

engaging and releasably locking the support means with the back-off apparatus with a recess formed by a connection to prevent further lowering of the apparatus upon lowering of the wireline and to support the back-off apparatus with the connection to sustain repeated jars from the jar; and manipulating the wireline for discharging an explosive with the back-off apparatus for exerting the explosive force to the support means and connection to impart a jarring or hammering force to the connection through the support means for effecting release of the threaded connection when a back-off torque is applied to the drill string.

12. The method as set forth in claim 11, whereby:

the step of engaging includes raising the apparatus with the wireline to release the support means from a first non-engaging position for lowering through the drill string to a second engaging and locking position for preventing the further downward movement.

13. The method as set forth in claim 12, whereby:

the step of engaging further includes lowering the apparatus with the wireline after movement of the support means to the second position to cam the support means into tight locking engagement with the recess formed by the connection.

14. The method as set forth in claim 11, whereby:

the step of exploding includes imparting a hammering or jarring blow to the connection through the support means in addition to the explosive force to effect release.

15. The method as set forth in claim 11, whereby:

the step of engaging and releasable locking is performed by manipulating the wireline from the upper end of the drill string.

16. The method as set forth in claim 11, including the step of:

releasing the supporting means from the connection by raising the wireline after discharging the explosive device.

17. The method as set forth in claim 16, including the steps of:

raising the back-off apparatus to another connection in the drill string;

engaging and releasably locking the support means with the other connection to prevent lowering to the tool; and imparting a hammering or jarring blow to the connection through the support means with the jar for effecting release of the other connection when a back-off torque is applied to the drill string.

18. The method as set forth in claim 11, including the step of:

imparting hammering or jarring blows to the connections through the support means with the jar after discharging the explosive device and not releasing the connection for effecting the release of the connection.

* * * * *